US005362518A

United States Patent [19]

Johnson

[11] Patent Number: 5,362,518

[45] Date of Patent: Nov. 8, 1994

[54] METHOD FOR WATERCOLOR PAINTING USING ROCK SALT

[76] Inventor: Rodney J. Johnson, 6400 Hwy. 66, Ashland, Oreg. 97520

[21] Appl. No.: 208,462

[22] Filed: Mar. 9, 1994

[51] Int. Cl.[5] ..... B05D 1/38

[52] U.S. Cl. ..... 427/259; 427/260; 427/262; 427/274; 427/326

[58] Field of Search ..... 427/198, 259, 260, 262, 427/264, 267, 270, 274, 277, 280, 288, 326

[56] References Cited

U.S. PATENT DOCUMENTS

| | | | |
|---|---|---|---|
| 3,093,462 | 6/1963 | Rapaport . | |
| 4,025,666 | 5/1977 | Pierce | 427/197 |
| 4,582,725 | 4/1986 | Nakashima | 427/193 |
| 4,730,020 | 3/1988 | Wilfinger | 524/555 |
| 4,734,302 | 3/1988 | Baskin | 427/198 |
| 4,812,340 | 3/1989 | Cripe | 428/15 |
| 4,956,018 | 9/1990 | Kranz et al. | 106/401 |

*Primary Examiner*—Terry J. Owens
*Attorney, Agent, or Firm*—Richard C. Litman

[57] ABSTRACT

A decorative painting is made by wetting a paper substrate, stretching the paper onto a rigid flat board, drying the paper, defining outlines of figures on the paper, masking the outlines, applying watercolor to the paper, applying crystals of rock salt on the watercolor by a method such as dropping, throwing, or scattering while the watercolor is wet, drying the watercolor, removing the rock salt, paining the figures, removing the masking, and painting the outlines. The rock salt reacts with the wet watercolor to create decorative gradiations in pigmentation.

12 Claims, 5 Drawing Sheets

METHOD FOR WATERCOLOR PAINTING USING ROCK SALT

BACKGROUND OF THE INVENTION

1. Field of the Invention

The present invention relates to the art of decorative painting. More specifically, the present invention relates to a process of wet-on-wet painting using watercolors, which includes the application of rock salt.

2. Description of the Prior Art

Painting methods which include application of granular materials have been the subject of prior patents. For example, U.S. Pat. No. 3,093,462 to Rapport discloses a process for making a decorative painting wherein adhesive is applied as the outline for a picture, and granulated materials are applied to the adhesive. After the granulated materials are secured to the adhesive, and excess granules removed, the picture is painted.

U.S. Pat. No. 4,025,666 to Pierce discloses a process for coloring the border panel of a cardboard picture mat. Finely divided powder containing pigment and whitenet are filled into a dry surface, then buffed to produce an even tone.

U.S. Pat. No. 4,582,725 to Nakashima discloses a surface treating method wherein a powdered glassy material is sprayed onto a surface to be further painted.

Wet-on-wet application of coats of differing materials during multi-coat painting processes are also known. For example, U.S. Pat. No. 4,730,020 to Wilfinger et al. discloses water-dilutable coating compositions which are used as the base or first coat of a multi-coat system where there is wet-on-wet application of a clear coat on the first or base coat. The composition includes a vinyl, vinylidene, or acrylic acid polymer component, solvents, and one or more coloring (or optical effect imparting) component.

U.S. Pat. No. 4,812,340 to Cripe discloses a method for simulating natural desert varnish with a composition that includes a solution of an alkali base and a solution of a metallic salt.

Rock salt has been used in the production of pigments. For example, U.S. Pat. No. 4,956,018 to Kranz et. al. discloses a method for making pigments which includes grinding crude colors with rock salt and dialkyl phthalates, phenoxyethanol, 2-phenylethanol and/or dialkyl benzoates.

None of the above inventions and patents, taken either singly or in combination, is seen to describe the instant invention as claimed.

SUMMARY OF THE INVENTION

The present invention relates to a water color painting process which includes the application of rock salt. Creating a decorative painting usually is a time consuming endeavor. Typically, there is a painted center of interest or figure, such as a person, animal, group of people or animals, or an architectural feature. In addition, environments for the center of interest must be rendered, such as skies or seas, for outdoor settings.

The present invention allows paintings to be created more quickly, yet allowing the artisan to concentrate on the center of interest, by reducing the time necessary to create the environments for the center of interest. Further, the effect achieved by the application of rock salt to wet watercolor is visually unique from painting to painting, achieving effects both lively and contemplative. The instant process is very effective in capturing the variations of closely related colors in seemingly random patterns, such as the blues found in the sky and in underwater marine settings.

Accordingly, it is a principal object of the invention to provide a method for creating decorative painted surfaces which includes the application of crystals of rock salt to wet paint.

It is another object of the invention to provide a watercolor painting method which can be carried out in a shorter period of time than conventional methods.

It is a further object of the invention to provide a painting method which produces unique decorative effects.

Still another object of the invention is to simulate the random variegation of related hues present in natural skies, seas, and the like.

These and other objects of the present invention will become readily apparent upon further review of the following description and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

The present process for creating a decorative painting, includes as the basic steps a) applying watercolor to a paintable paper surface, b) applying crystals of rock salt to said watercolor while said watercolor is in a wet state, c) drying the watercolor, and d) removing the crystals of rock salt. The paintable paper surface 1 is preferably a flat heavy weight paper. Preferably, commercially available 100–300 wt. rough watercolor paper or cold pressed paper is used. Most preferably, a 140 wt. rough watercolor paper is used.

Figure 1:
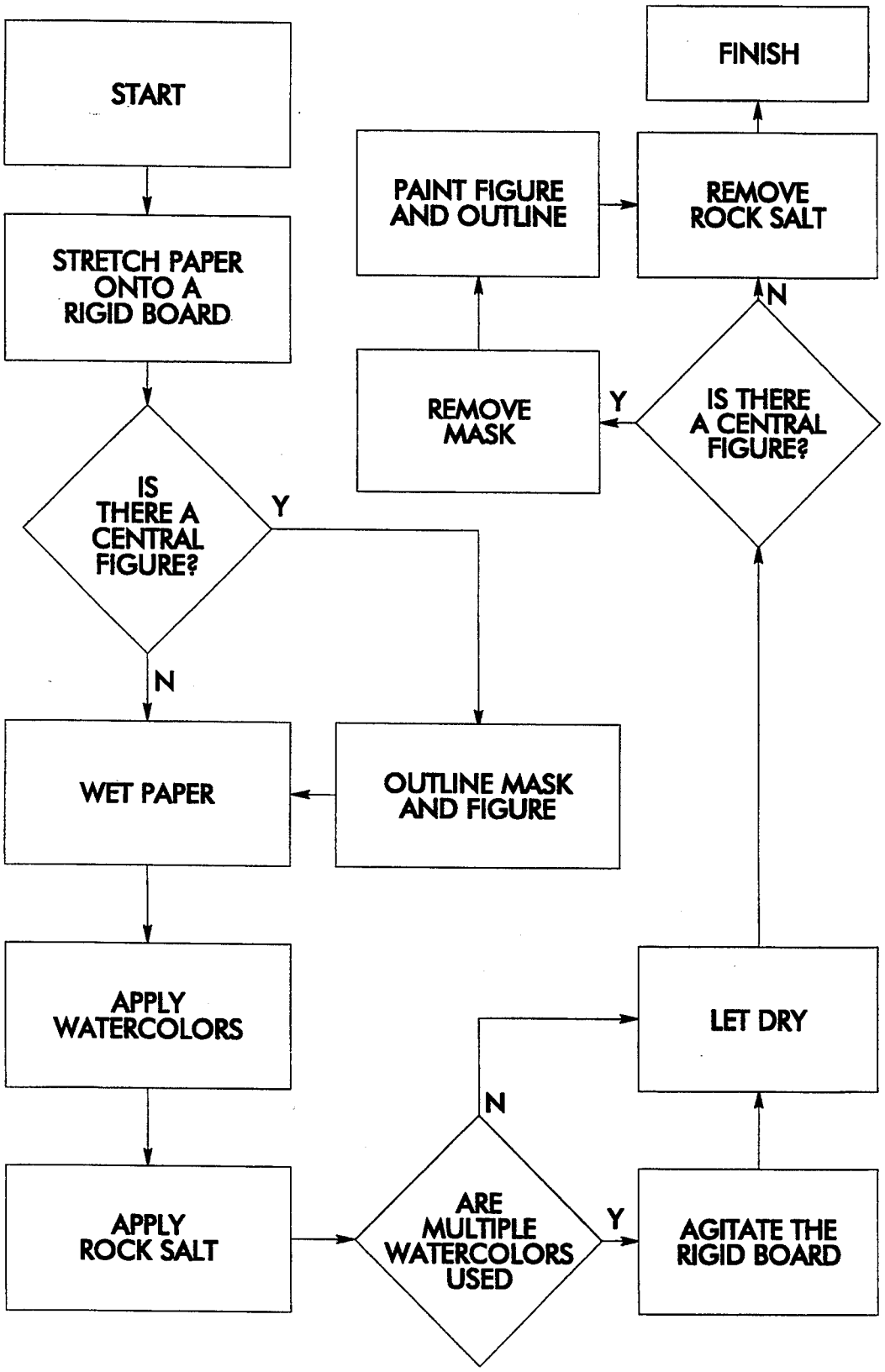
FIG. 1 is a flow chart of a preferred embodiment of the present invention.
Figure 2:
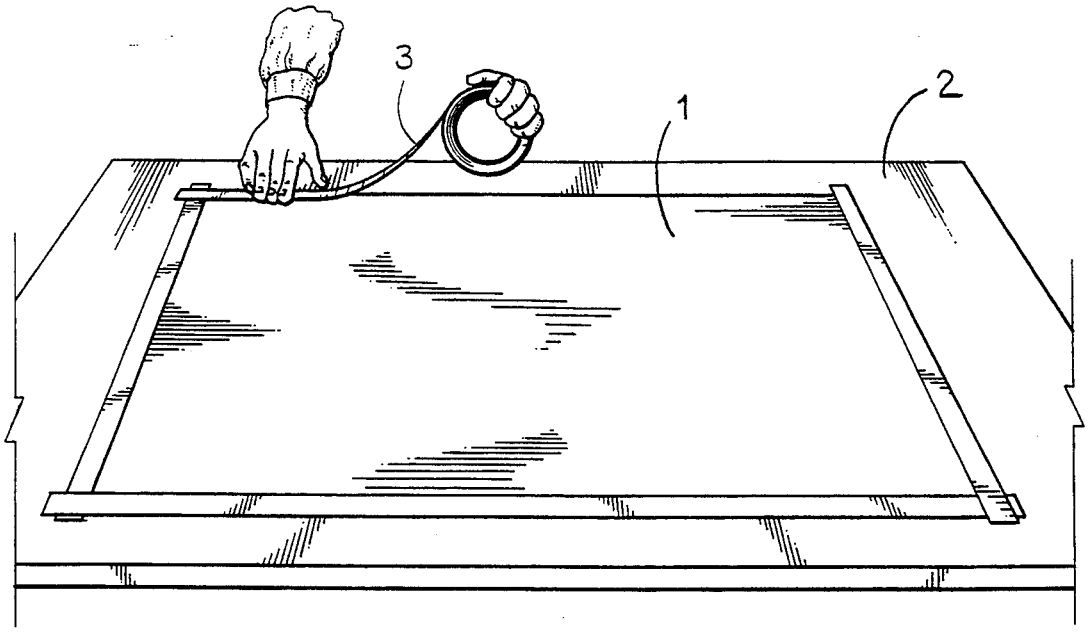
FIGS. 2, 3, 4, 5, 6, 7, 8 and 9 are perspective views showing progressive steps of a preferred embodiment of the present invention.
Figure 3:
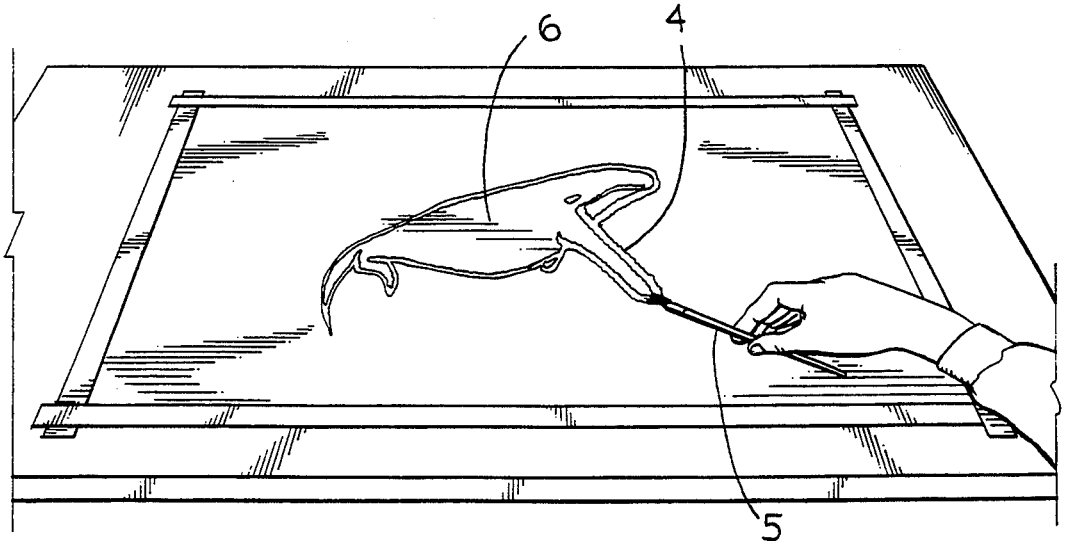

Preparatory steps may be performed prior to a) which include wetting the paper surface and stretching the paper surface onto a rigid flat board 2. Preferably, the stretched paper is secured to the board, preferably using tape 3, as shown in FIG. 2. Preferably, tape 3 is a wide gummed paper tape such as QUIK STIK TM, produced by Gould Packaging, Inc. Gummed paper tape of about 2" width is most advantageously used for this step. The tape may be cut to length, and wetted with a sponge, or the like, to activate the adhesive. Once the tape is applied to the paper surface and both are allowed to dry, the paper is advantageously pulled flat upon the rigid board. If a FIG. 6 or other center of interest is desired, these may be outlined and masked, as shown in FIG. 3. The outlining may be done by pencil sketching or the like, or with the masking medium 4. Artist's rubber cement or the like may be used as the masking medium, which may be applied with a fine brush 5.

Figure 4:
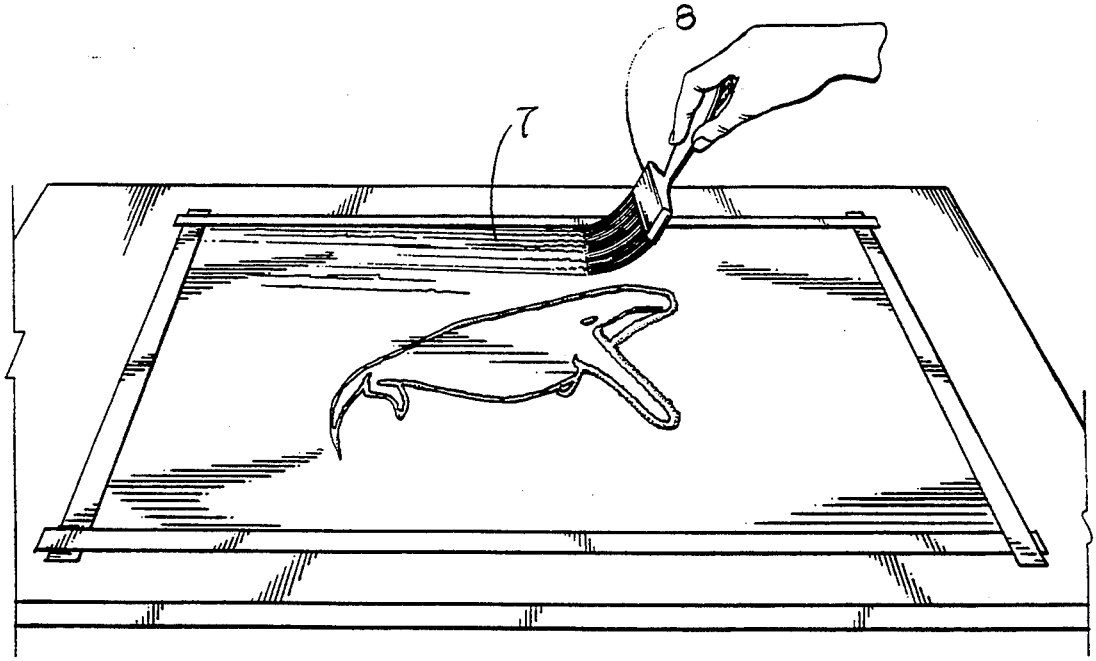
Figure 5:
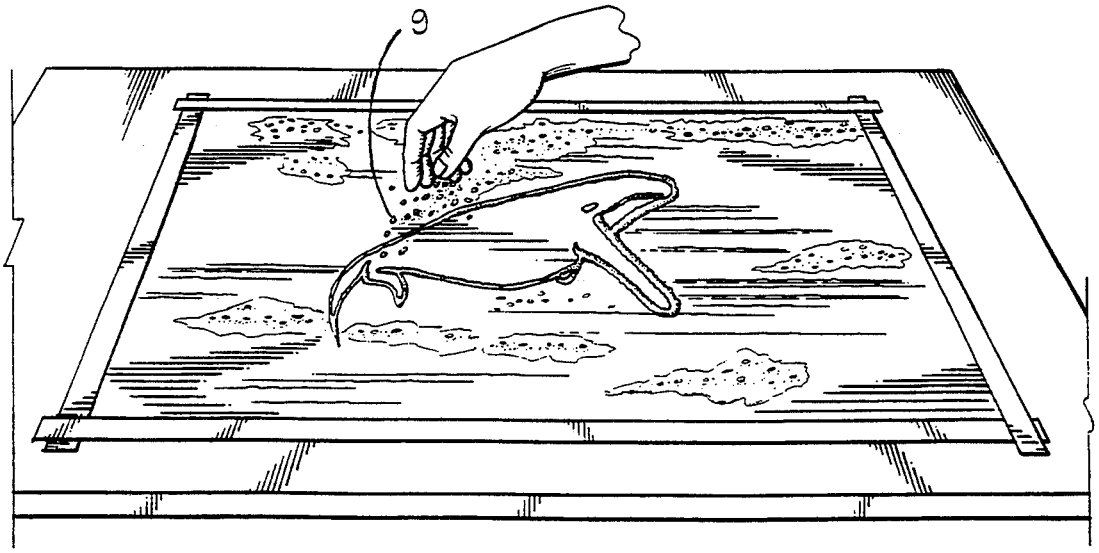

After the paintable surface has been prepared, it is rewetted with water. Watercolor 7 is then applied to the wet paper surface, as shown in FIG. 4. Preferably, the watercolors used are selected from shades of blue, green, and yellow. The watercolor pigments are preferably prepared in a palette with large reservoirs for the primary shades to be applied. Preferably, a dense or concentrated watercolor is prepared. Accordingly, the pigments are mixed with only a small quantity of water in the reservoirs. For example, between ¼ to ½ of the water normally used for conventional watercolor paintings is presently most preferred. The use of one watercolor pigment is sufficient to create the desired effect. However, it is more preferable to use at least two different shades of, for example, blue, green, or yellow watercolors. Most preferably, three to eight shades of closely related colors, such as shades of blue, especially for simulating oceans or skies, are used. Other groups of related colors, such as shades of crimson/orange/red may be used for sunset skies, and the like.

The watercolors are applied to the paper quickly, preferably with a wide brush 8, as shown in FIG. 4. A ½" to 1" brush may advantageously used. When multiple shades are used, they may be applied in slightly overlapping zones. If desired, highlight colors may be applied with a smaller brush. Paint is applied to the entire paper surface, with the exception of any area defined by the masked outlines, if present.

Immediately after the paint is applied, rock salt crystals 9 are scattered, thrown or otherwise applied to the wet pigment. Preferably, at least 25% by weight of the crystals of rock salt are granules having at least one cross-sectional dimension of between about TM" and ¼". Accordingly, some of the rock salt may be ground to a finer grade. Most preferably however, substantially all of the crystals of rock salt are granules having at least one cross-sectional dimension of between about ⅛" and ¼".

The size or sizes of rock salt crystals used will influence the resulting decorative effect of the painting. Smaller crystals of rock salt produce less extensive and finer patternings than larger crystals. Accordingly, a mixed grade will produce a range of effects from small to large patterns. When exclusively larger crystals are used, i.e. substantially all crystals having a dimension of between about ⅛" to ¼", the most dramatic and extensive effect is achieved. The rock salt crystals are applied such that at least a majority of the crystals will be in contact with the paper surface through the applied pain. Accordingly, some force should be used in their application.

Substantially concurrent with the application of rock salt, the paintable paper surface may be agitated such as by slow displacement of the rigid flat board to which the paper is secured. This agitation allows the paint to randomly flow and helps to create chaotic patterns along with the rock salt. Agitation is most effective when multiple shades of watercolor are used.

The rock salt crystals react with the wet watercolor to create blooming dispersion patterns 13 in the paining. Further, pigment collects underneath the crystals, thereby creating contrasts which would normally require extensive brush work to recreate. As the patterns manifest in the painting, additional paint may be applied, if desired, to increase color intensity or richness. When further paint is applied, additional rock salt may added. The reaction created by the application of rock salt to watercolor is substantially spontaneous. Accordingly, it is more preferable that no further pain is applied to the areas with rock salt crystals adhered thereto, or alternatively, that nay additional application of paint and/or rock crystals be performed very quickly.

Figure 8:
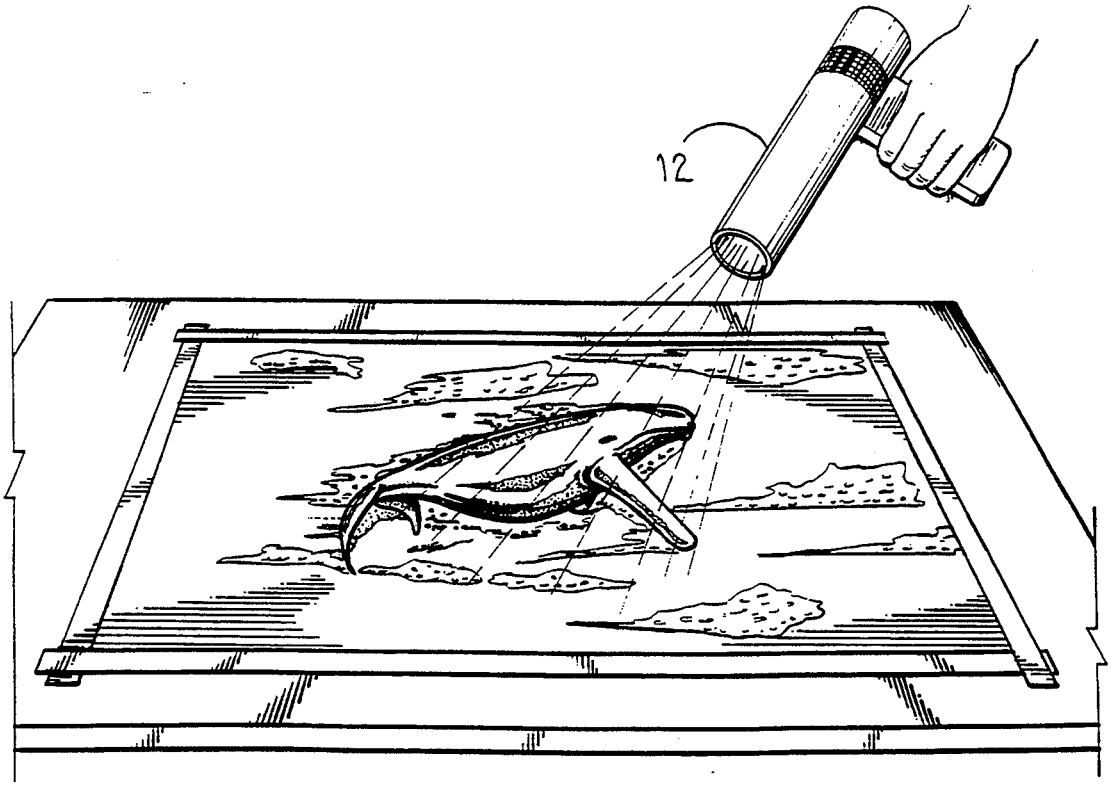

The painting is then dried. This may be accomplished by exposure to normal room atmospheric conditions for sufficient time to allow all water in the paint to evaporate. Typically, between 2–5 hours is sufficient. This step may be accelerated by using a blowing type hair drier 12, as shown in FIG. 8, or other heating means, such as a light bulb. Sunlight, however should be avoided. Most preferably, the painting is allowed to dry at normal room conditions. When an artificial drying technique is used, such as a 100–150 watt light bulb, it is not essential that the entire surface is uniformly dried by that technique. For example, a light bulb may be suspended at about six to eight inches from a particular region of the painted surface, thereby drying this region more quickly than the remainder of the painted surface.

Figure 9:
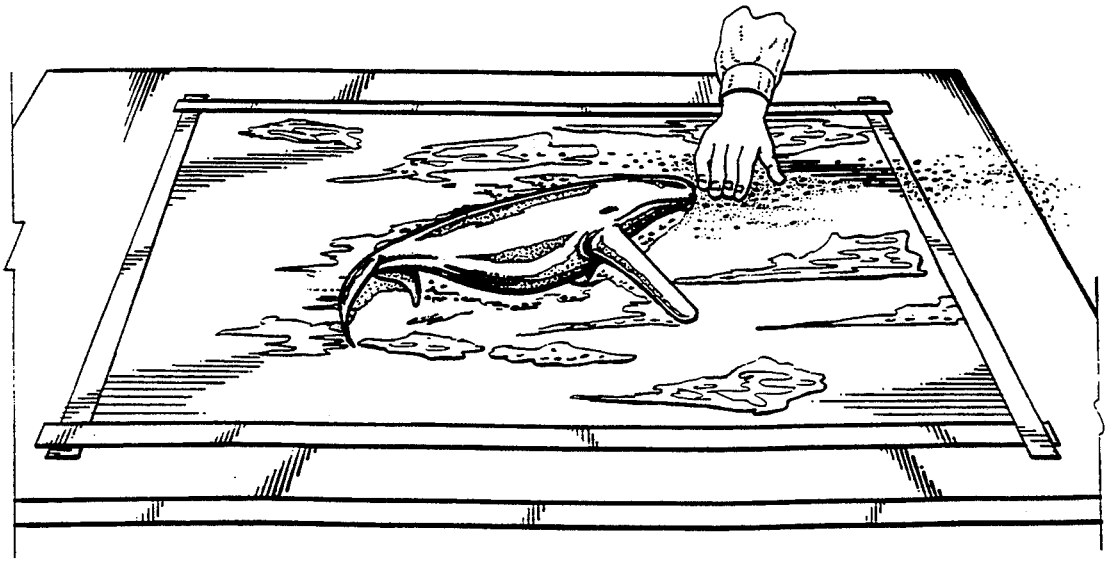

Once the painting is completely dried, the rock salt crystals are removed from the surface of the painting. This may be done by manually brushing the rock salt off of the paper surface, as shown in FIG. 9, or with any suitable means, such as a brush or a straight edge. Preferably, the rock salt is removed by manually brushing off the crystals with an index finger or thumb. When a straight edge is used, such as a razor blade, care must be taken to avoid marring the watercolor paper. A straight edge is most useful when finer grades of rock salt crystals have been used. For example, a razor blade positioned flat on the painted surface may be used to lightly scrape away finer crystals.

Figure 6:
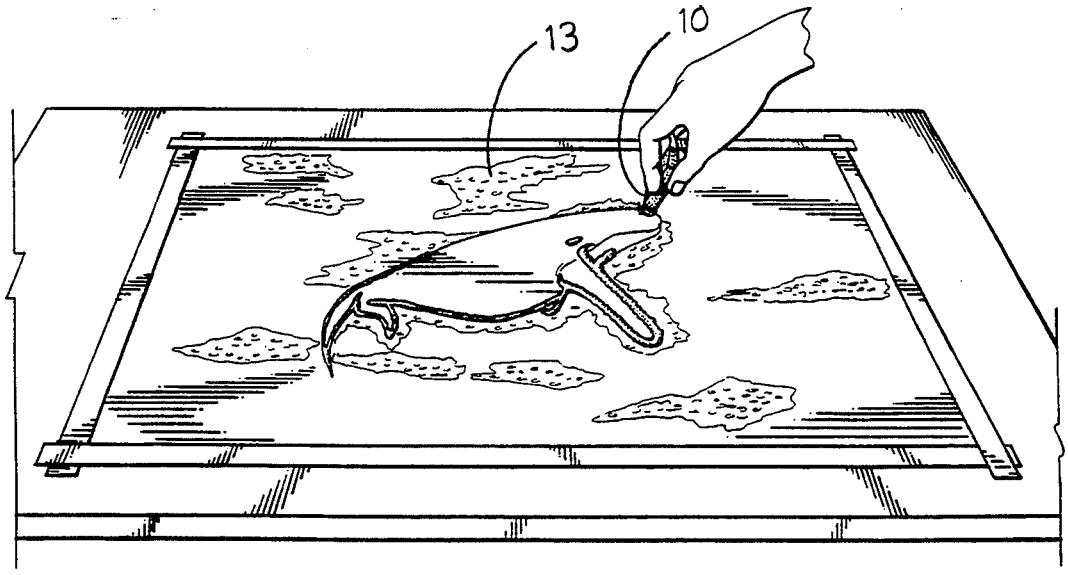
Figure 7:
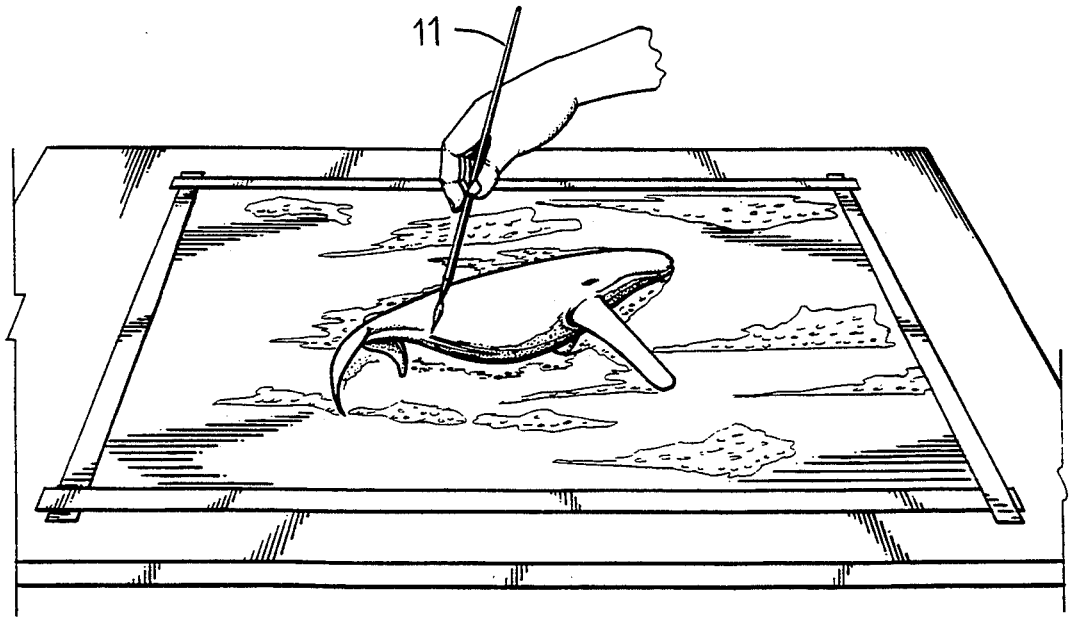

If a figure or center of interest had been masked, finishing steps may be then be performed which include painting the foreground figures, as shown in FIG. 7, removing masking, as shown in FIG. 6, and painting the exposed outlines, as shown in FIG. 7, and drying, as shown in FIG. 8. These steps may be performed in any convenient order. An eraser 10 may be used in removing the masking. Preferably, a fine brush 11 is used for painting the figure. Alternatively, these finishing steps may be performed after the paint has dried under the rock salt crystals, and prior to the crystal's removal.

By using the present process, the time required to create unique decorative paintings is drastically reduced by reducing the amount of fine brushwork necessary to complete a given work. Further, the resulting chaotic patterns are created without the need for intricate design planning. Accordingly, the present technique allows painters, professional or novice alike, to create watercolors which have visually stimulating impact.

It is to be understood that the present invention is not limited to the sole embodiment described above, but encompasses any and all embodiments within the scope of the following claims.

I claim:

1. A method for creating a decorative painting, comprising the steps:

a) applying watercolor to a paintable paper surface;

b) applying crystals of rock salt to said watercolor while said watercolor is in a wet state;

c) drying the watercolor onto said paintable paper surface; and d) removing the crystals of rock salt.

2. The method according to claim 1, further comprising the preparatory steps performed prior to a):

i) wetting said paintable paper surface;

ii) stretching said paper surface onto a rigid flat board;

iii) drying said paper surface;

iv) defining outlines for foreground figures on said paper surface; and v) masking said outlines.

3. The method according to claim 2, further comprising the finishing steps performed after step d):

I) painting said foreground figures;

II) removing said masking; and

III) painting said outlines.

4. The method according to claim 3, wherein at least 25% by weight of said crystals of rock salt consist of granules having at least one cross-sectional dimension of between about $\frac{1}{8}''$ and $\frac{1}{4}''$.

5. The method according to claim 4, wherein substantially all of said crystals of rock salt consist of granules having at least one cross-sectional dimension of between about $\frac{1}{8}''$ and $\frac{1}{4}''$.

6. The method according to claim 3, wherein said drying in step c) is accomplished with a hair dryer.

7. The method according to claim 3, wherein said drying in step c) is accomplished by exposure to normal room atmospheric conditions for sufficient time to effect said drying.

8. The method according to claim 3, wherein said watercolor includes at least one shade selected from shades of grey, blue, green, and yellow.

9. The method according to claim 8, wherein said watercolor includes at least two of said shades.

10. The method according to claim 9, wherein said watercolor includes three to eight shades of blue.

11. The method according to claim 9, wherein during step b), said paintable surface is agitated.

12. The method according to claim 11, wherein said paintable paper surface is agitated by displacement of said rigig flat board.

* * * * *